US008366451B2

(12) United States Patent
Littek et al.

(10) Patent No.: US 8,366,451 B2
(45) Date of Patent: Feb. 5, 2013

(54) CONTACT ARRANGEMENT

(75) Inventors: Martin Littek, Korb (DE); Andreas Michael Schremmer, Berglen (DE); Bernd Hagmann, Bad Ueberkingen (DE); Marcus Bihrer, Althengstett (DE)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 13/217,190

(22) Filed: Aug. 24, 2011

(65) Prior Publication Data

US 2012/0052752 A1 Mar. 1, 2012

(30) Foreign Application Priority Data

Sep. 1, 2010 (DE) ..... 10 2010 044 612

(51) Int. Cl.
*H01R 39/00* (2006.01)

(52) U.S. Cl. ..... 439/12

(58) Field of Classification Search ..... 439/246–252, 439/924.1, 11, 12, 31; 200/254, 255, 256
See application file for complete search history.

(56) References Cited

U.S. PATENT DOCUMENTS

| | | | | |
|---|---|---|---|---|
| 2,408,583 | A | 7/1943 | Simons | |
| 4,423,917 | A * | 1/1984 | Scheingold et al. | 439/249 |
| 5,085,601 | A * | 2/1992 | Buchter et al. | 439/660 |
| 7,168,990 | B2 * | 1/2007 | Suzuki et al. | 439/636 |
| 7,806,711 | B2 * | 10/2010 | Andersen et al. | 439/251 |

* cited by examiner

*Primary Examiner* — Ross Gushi
(74) *Attorney, Agent, or Firm* — Leon D. Rosen

(57) ABSTRACT

A contact arrangement (10) comprising fork-shaped contacts (15) that engage opposite faces of a blade contact (18). For good heat dissipation together with low transition resistance, the contact arrangement is made up of multiple planar, i.e., plate-shaped, fork contacts (15), which are supported and connected to each other on a shaft-like carrier (16) that is joined to a perpendicular connecting unit (14).

7 Claims, 4 Drawing Sheets

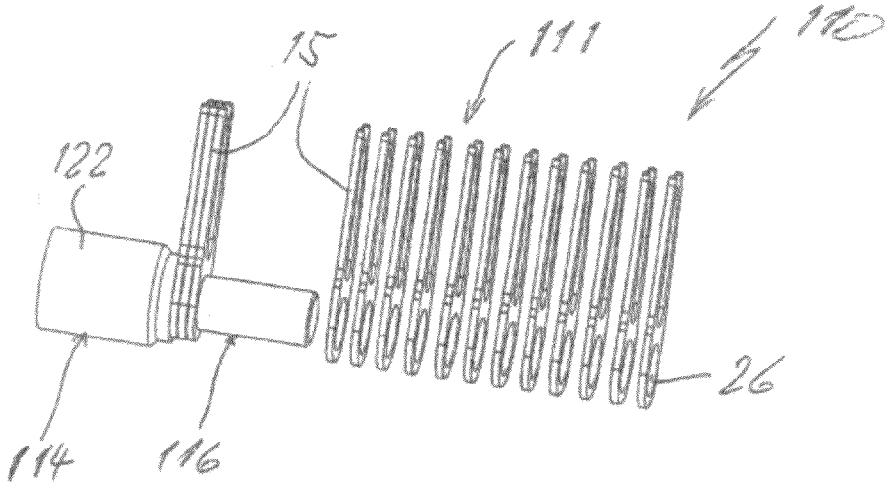
Fig. 4
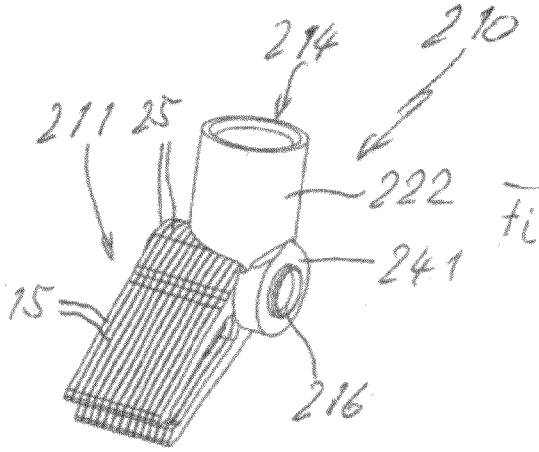
Fig. 5
Fig. 6
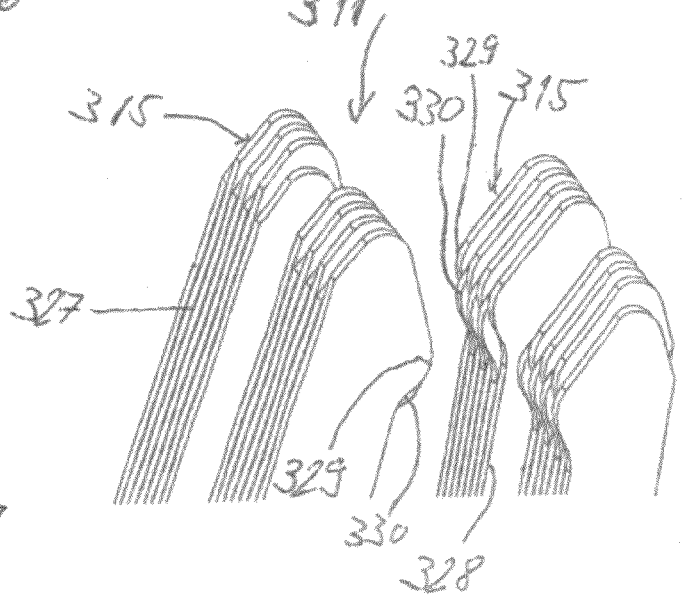
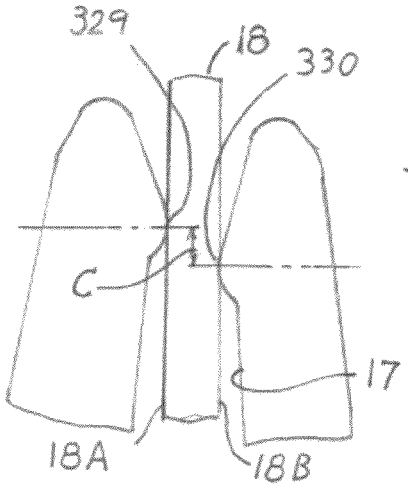
Fig. 6A

CONTACT ARRANGEMENT

CROSS-REFERENCE TO RELATED APPLICATION

Applicant claims priority from German patent application no. 10 2010 044 612.2 filed Sep. 1, 2010.

BACKGROUND OF THE INVENTION

The present invention relates to an electrically conductive contact arrangement.

In electrically conductive contact arrangements in systems of high specific power density, it is essential, on the one hand, to keep the Joule heating small through having minimal thermal resistances of the contact units that are to be, or have been, connected to each other, and, on the other hand, to remove the residual heat through good heat dissipation into other current-carrying components. In this context, the decisive parameters are selecting materials for the contact units along with their coatings, having the greatest possible number of contact points, determining the magnitude of the contact forces compatible with reasonable ease of operation, and ensuring the largest possible masses and cross-sections in the contact arrangement.

According to the prior art, in electrically conductive contact arrangements for high-performance applications, either contact units have been known that are manufactured with great geometric precision and are therefore expensive, or the contact arrangements have been provided with expensive, delicate spring contacts as supplemental parts.

From DE 10 2008 031 571 A1, an electrically conductive contact arrangement is known for high-performance current transmission, in which one pole is formed by multiple spring contacts, which together constitute a plug-in aperture and which are supported, each with spacing from the others, within attachment openings of a contact support that is made of insulating material, said electrically conductive contact arrangement therefore offering neither optimal electrical contacting nor optimal heat dissipation.

It is the objective of the present invention to create an electrically conductive contact arrangement of the aforementioned type, which is less expensive and can be manufactured cost-effectively in large quantities and which in addition to low transition resistances offers excellent heat dissipation.

SUMMARY OF THE INVENTION

As a result of the measures according to the present invention, an electrically conductive contact arrangement is created, which can be manufactured in a simple manner by placing spring fork contacts in a row and which can be adjusted to the relevant, or calculated, maximum current transmission power. Thus planar spring fork contacts may be manufactured cost-effectively, for example, as a simple stamping part and in large quantities. The same applies to assembling and holding together this multiplicity of planar spring fork contacts on one carrier and connecting it to a connecting unit. As a result of this way of assembling planar. i.e., plate-shaped, spring fork contacts, the geometry of these contacts may be easily adjusted to the requirements of specific applications, and also with respect to the mating contact. The characteristics of the spring fork contacts are relatively easy to model in one plane due to the planar quality of the component.

The individual spring fork contacts may be strung, for example, onto a tubular carrier in a simple manner in any quantity, and then they may be fixed, or joined, to form a massive composite. A carrier of this type provides a multiplicity of contact points and at the same time a large mass for heat transport, while maintaining a high packing density.

Manufacturing methods using roller burnishing yield the massive composite, whereby the connecting points may be gas-tight and cold-welded so that the lowest transition resistances may be achieved.

The individual spring fork contacts may be held on the carrier in such a way that they are arranged either all in one packet, directly contacting each other, or in multiple adjoining packets.

Even the stringing of the spring fork contacts onto the carrier is accomplished in a rotationally fixed arrangement.

A reduction in the plug-in forces is possible because, due to the assembly of spring fork contacts having springs of alternating orientations on the carrier, the blade may be inserted into the spring fork contact unit in a substantially gentler manner due to the serial contacting. It is preferred that the two spring legs of a spring fork contact be of varying lengths and that adjoining spring fork contacts be rotated 180° about their central axis.

By stringing the individual spring fork contacts, which are configured, for example, as sheet metal or as stamped metal, onto the carrier, further arrangements of function elements are optionally possible. Thus, for example, one or more connecting units as well as elements to ensure a latching support of the spring fork unit within a housing may be optionally strung as intermediate- and/or end elements.

One or more connecting units may be arranged on corresponding areas on the end side of, or between spring fork contacts. In the case of the axial orientation, the connecting unit is integrated with the carrier in a way that is technically simple in production terms, thus yielding a very compact design, and in the case of the right-angle orientation, various optional angular positions are possible between the axis of the connecting unit and the axis of the carrier.

The connecting unit may be provided as a crimped element or as a screw element for the relevant conductor or conductors. In addition, by providing two or more connecting elements, division into two or more terminals is advantageously possible at high current levels.

A selectable arrangement of the housing latching elements is also achieved with the stringing of the spring fork contacts.

A blade contact unit that fits with the fork-shaped spring contact unit is also advantageously configured so as to be planar and plate-shaped, whereby depending on the installation space, the connecting unit may be arranged so as to be perpendicular or transverse with respect to the insertion direction of the blade contact. This planar, plate-shaped configuration provides the option of inserting the blade contact into the female contact device both from the end face as well as longitudinally. This is advantageous for use in the most varied kinds of configurations of plug-in connectors. The design as a right-angled contact is advantageous in applications in which the users during operation must be protected with shock hazard protection and/or figure protection; the relevant grip opening is never much larger than the material thickness of the blade contact.

As a flat component, the blade contact is easy to modify. Various cutouts in the contact area are possible, on the basis of which the plug-in process may be further optimized by sliding the spring forks serially. This provides for a further reduction in the plug-in forces and support for a gentle insertion of the blade contact into the spring fork contacts.

The blade contact unit is provided with a housing locking element, in the area of the connecting unit, for example.

The blade contact unit may be manufactured in a simple manner.

Further details of the invention may be derived from the following description, in which the invention is described and explained in greater detail on the basis of the exemplary embodiments that are depicted in the drawing.

DESCRIPTION OF THE DRAWINGS

FIG. 4 is an isometric view of a spring contact arrangement of a second embodiment of the invention and in a state in a one assembly step.

FIG. 5 is an isometric view of a spring contact unit in accordance with a third embodiment of the present invention in the assembled state.

FIG. 6 is an enlarged isometric view of the free front, or top, area of the spring contact unit of FIG. 1, but in accordance with a fourth exemplary embodiment of the present invention.

FIG. 6A is a partial elevation view of a fork contact of the unit of FIG. 6.

DESCRIPTION OF THE INVENTION

Figure 1:
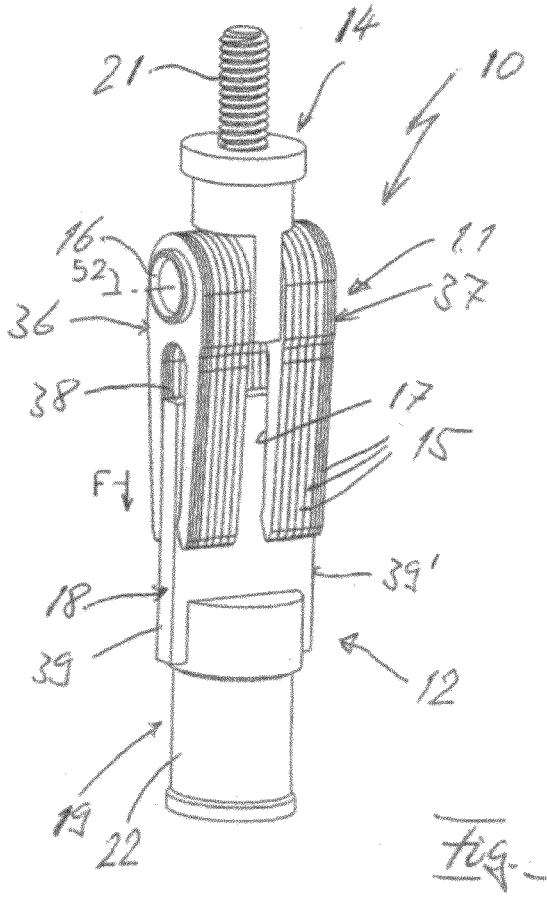
FIG. 1 is an isometric view of an electrically, conductive contact arrangement made of a fork-shaped spring contact unit and a blade contact unit in the electrically connected, i.e., plugged-together, state in accordance with a first exemplary embodiment of the present invention.

FIG. 1 shows an electrically conductive contact arrangement 10 for plug-in connections handling high transmission power, as is the case with electrically operated motor vehicles, for example. The contact arrangement includes a fork-shaped spring contact unit 11 and a blade contact unit 12 that are connected together. Spring contact unit 11 has a multiplicity of planar, plate-shaped spring fork contacts 15, or fork contacts, which are strung on a shaft 16 in the form of a tubular carrier 16, and has a connecting unit 14 that is also connected to the carrier. The fork contacts extend along a stack axis 52.

Blade contact unit 12 has a planar, plate-shaped blade contact 18 which has electrically conductive opposite faces 18A, 18B (FIG. 6A). Each fork contact forms a slot 17 (FIG. 3) and each fork contact 15 resiliently engages the blade contact opposite faces. A connecting unit 19 (FIG. 1), is electrically connected to blade contact 18. Connecting unit 14 is provided with fork contacts 15 in axial alignment, and connecting unit 19 is provided with blade contact 18 in axial alignment with the slots in the fork contacts. Connecting unit 14 has a threaded pin 21 extending perpendicular to axis 52, for the screw attachment of an electrical conductor. Connecting unit 19 on blade unit 12 is configured as a crimped sleeve 22, by means of which the relevant electrical conductor may be connected to blade contact unit 12 in crimped fashion.

FIG. 1 shows that the blade contact 18, shown here as rectangular, is inserted into slots 17 of spring fork contacts 15 with a narrow side 38 of the blade contact at its top. However, it is also possible to insert identical blade contact unit 12 into slot 17 of spring fork contact 15 with one of its two longitudinal sides 39, 39' in front (at the top).

Figure 3:
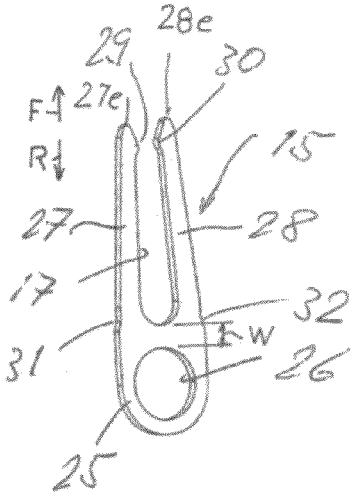
FIG. 3 is an isometric view of a spring fork contact of the contact arrangement of FIG. 1.
Figure 2:
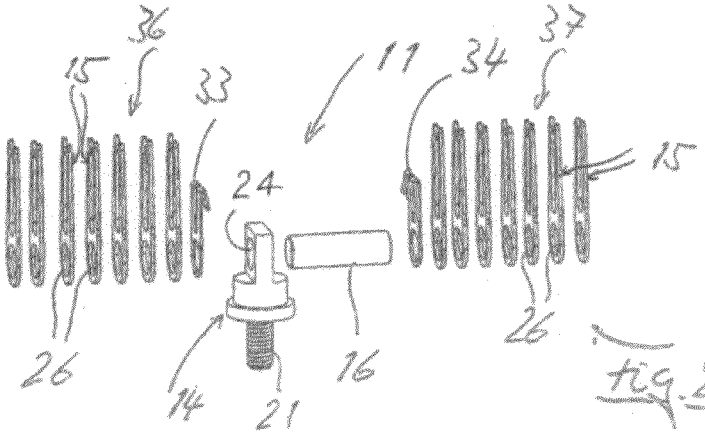
FIG. 2 is an exploded isometric view of the contact arrangement of FIG. 1, but in accordance with a variant.

FIG. 2 shows the assembly of spring contact unit 11, which is made up of multiple spring fork contacts 15, one of which is depicted in FIG. 3 in an enlarged view. Each spring fork contact 15 has a rearward R base area 25, which is provided with a cutout in the form of a borehole 26. The hole 26 is preferably circular to allow the fork contact to pivot. The base area 25 of the contact preferably leaves a width W of material between the hole 26 and the slot 17. Each fork contact has two spring legs 27, 28 that protrude forwardly (F) in FIG. 1. The legs of each fork contact have upper, or forward free ends 27*e*, 28*e* that form contact points or surfaces 29, 30 which point generally towards each other, and that protrude into slot 17. The contact points 29, 30 contact the double-sided external surfaces of blade contact 18. In one area adjoining the base of slot 17, the external edges of spring legs 27, 28 are each provided with a notch 31, 32 which facilitate latching retention in an undepicted plug-in connector housing.

Spring fork contact 15 is manufactured from a planar, relatively thin metal plate, preferably as a single-piece stamped part. However, other, familiar, cutting methods are also suitable, e.g., laser cutting or water jet cutting.

In order to manufacture spring contact unit 11, a multiplicity of spring fork contacts 15 (FIG. 2), which in this exemplary embodiment are identical, stamped parts, are strung onto carrier 16, which is a shaft in the form of a tubular sleeve. Connecting unit 14, which is also provided with a borehole 24 (FIG. 2), is strung onto carrier 16, and then a number of fork contacts 15 are strung on both sides of this connecting unit 14. According to one variant shown in FIG. 2, a locking element 33, 34, whose slotted free ends are bent so that they point towards each other and are therefore shorter in the longitudinal extension, is placed on both sides of connecting unit 14, in contrast to the completely assembled spring contact unit 11 of FIG. 1. Locking elements 33, 34, for example, facilitate the latching retention of spring contact 11 in an undepicted plug-in connector insulating housing.

Figure 3A:
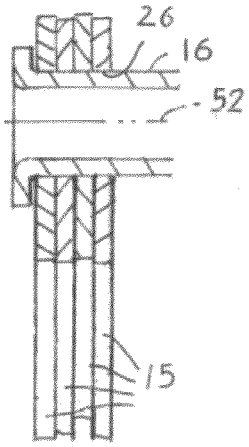
FIG. 3A is a partial sectional view of the contact arrangement of FIG. 1.

As can be seen in FIGS. 1 and 2, two packets 36, 37 of fork contacts 15 are provided in contact unit 11. FIG. 1 shows two stacks of fork contacts on opposite sides of the connecting unit, with each stack, or packet, having seven fork contacts. Fork contacts 15 of both packets 36, 37 are fixed to carrier 16 by an interior burnishing process. All fork contacts 15 and both packets 36, 37 are in alignment. As shown in FIG. 3A, the fork contacts lie in a stack and the fork contacts lie face-wise adjacent and preferably in direct contact with adjacent fork contacts in the stack.

FIG. 4 shows a contact arrangement 110 of another embodiment of the invention, in which carrier 116 is an integral part of connecting unit 114. Tubular carrier 116 merges axially into a larger-diameter crimped sleeve 122 of connecting unit 114, so that connecting unit 114 is positioned perpendicular to the orientation of the spring fork contacts 15. FIG. 4 shows fifteen identical spring fork contacts 15 strung onto carrier 116 and fixedly connected to each other as one single packet and to carrier 116, for example, through an interior burnishing, so as to create spring contact unit 111.

In the embodiment of contact arrangement 210 of FIG. 5, a multiplicity of fork contacts 15 are strung on a tubular carrier 216 to form one single packet (as in FIG. 4), creating spring contact unit 211. An eye 241 of a connecting unit 214 is attached on one end of carrier 216. On a peripheral area of eye 241, connecting unit 214 has a crimped sleeve 222, whose axis is preferably perpendicular to the longitudinal axis of carrier 216. Crimped sleeve 222 extends beyond a partial area of carrier 216 and therefore of base area 25 (FIG. 3) of fork contacts 15. Before connecting unit 214 is fixed on carrier 216, the longitudinal axis of crimped sleeve 222 may be adjusted so that it lies at an angle with respect to the axis of carrier 216.

FIG. 6 shows an embodiment of spring contact unit 311 in the form of individually adjoining spring fork contacts 315, whose spring legs 327, 328 are of varying lengths. In this embodiment, adjoining spring fork contacts 315 are identical, but these spring fork contacts 315 are arranged so as to be alternately rotated 180° about their longitudinal central axis. This means that contact points 329, 330 lie at different heights. FIG. 6A shows the contact points 329, 300 being vertically spaced by distance C along the blade 18.

In FIG. 6 contact points 329, 330 are deflected one after the other in response to the insertion of a blade 18 of blade contact unit 12 in the insertion direction. As a result, the insertion, or plug-in force is reduced, and the blade contact 18 is inserted more gently into the packet, or adjoining packets, of spring fork contacts 15, 315. Of course, adjoining spring fork contacts 15, 315 may also be arranged on the basis of more than two contact points 329, 330, which are offset in the insertion, or plug-in, direction.

Figure 7:
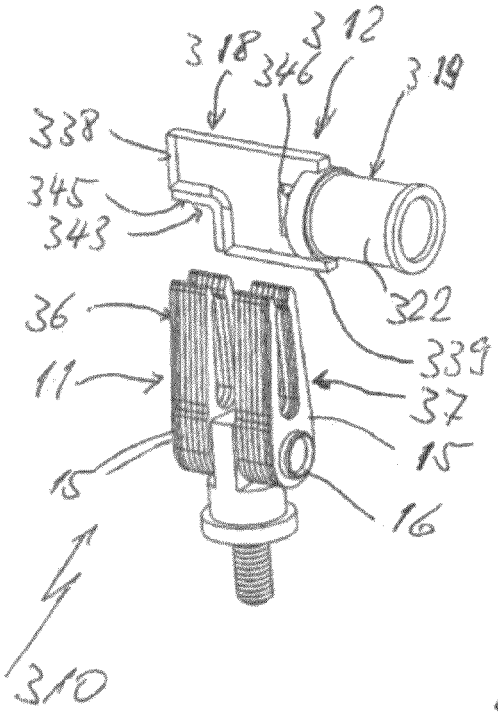
FIG. 7 is an exploded isometric view of a contact arrangement having a spring contact unit in accordance with FIG. 1 and a blade contact unit according to another embodiment of the invention.

In the embodiment of contact arrangement 310 in FIG. 7, a spring contact unit 11 of the construction of FIG. 1 is combined with a blade. Blade unit 312 has a crimped sleeve 322, which is in axial alignment with blade contact 318. In this blade contact unit 312, contrary to what is depicted in FIG. 1, the contact plug-in direction is selected so as not to be along the longitudinal axis of blade contact unit 312 but rather in a direction that is transverse to the longitudinal extension of blade contact unit 312.

A further difference between blade contact unit 312 and blade contact unit 12 in FIG. 1 lies in the configuration of blade contact 318. Blade contact 318 has a recess 343 on one of its ends facing away from crimped sleeve 322. The recess extends from longitudinal edge 339 of blade contact 318 and in the insertion direction, and therefore creates a returning edge 345 from longitudinal edge 339 in the direction of narrow edge 338. This means that during the insertion, the leading part of longitudinal edge 339 first achieves a contact connection with packet 37 of spring fork contacts 15, situated opposite, whereas the trailing, returning part of longitudinal edge 339 achieves an electrical contact connection with the other, adjoining packet, 36 of spring fork contacts 15. This signifies a reduction in the insertion, i.e. plug-in, forces that are occurring at this point in time between both units 11, 312. It is also possible to configure the edge areas and their rounded connection in step-wise fashion in the direction of their thickness.

In the design of FIG. 7, crimped sleeve 322 has locking elements 346 on both sides of blade contact 318. The locking elements facilitate latching retention and are an integral part of crimped sleeve 322.

Figure 8:
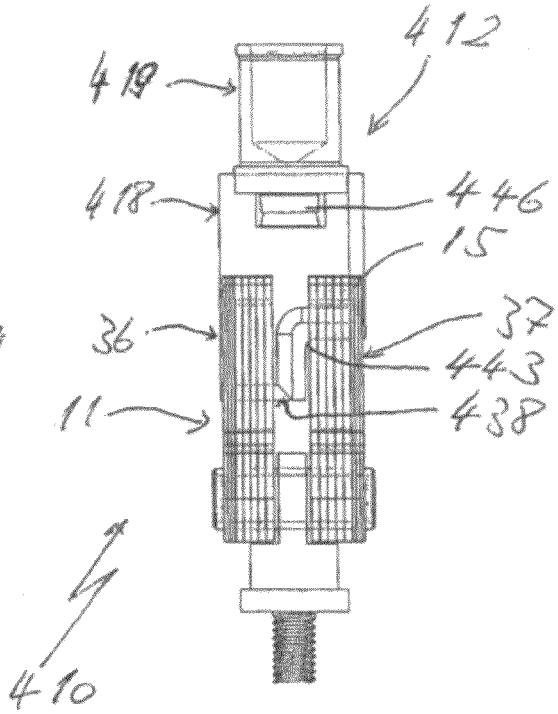
FIG. 8 is an elevation view of a contact arrangement similar to FIG. 7, but with a blade contact unit in accordance with another embodiment of the present invention and in the plugged-together, i.e., electrically contacting state.

In FIG. 8, a contact arrangement 410 is depicted, whose spring contact unit 11 is identical to spring contact unit 11 in FIG. 7 and FIG. 1 and blade contact unit 412 is similar to blade contact unit 312 in FIG. 7. However, in FIG. 8 the blade contact unit 412 is connected in plug-in fashion to blade contact unit 11 in its longitudinal extension. Connecting unit 412 is similar to connecting unit 312 in FIG. 7. Blade contact 418 corresponds to the shape of blade contact 318 in FIG. 7, except that here the leading edge is formed by a part of narrow edge 438 and, due to recess 443, the trailing edge is formed by the returning part of narrow edge 438. This means that the one longer area of blade contact 418 achieves a contacting connection with one packet 36 (or 37 in a 180° rotation of blade contact unit 412 about its longitudinal axis) from spring fork contacts 15 of spring contact unit 11. Also, the other, shorter, i.e. returning, longitudinal area of blade contact 418 achieves a contacting connection with other packet 37 (or 36 in a 180' rotation of blade contact unit 412 about its longitudinal axis). Here as well, connecting unit 419 has locking elements 446.

Figure 9A:
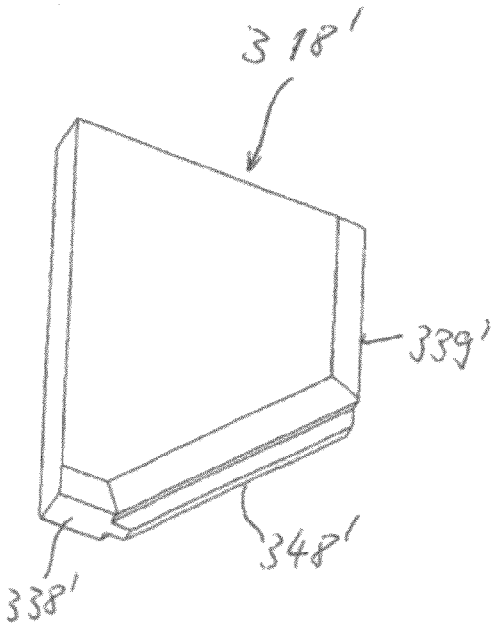
FIG. 9A and FIG. 9B are isometric views showing blade contacts of blade contact units in accordance with variants of the invention.
Figure 9B:
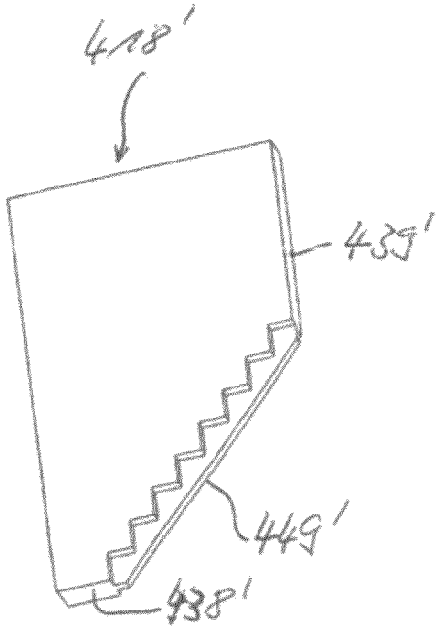

FIGS. 9A and 9B depict variants 318', 418' of configurations of blade contact 318, 418 in FIGS. 7 and 8, whereby in accordance with FIG. 9A the leading narrow or longitudinal edge, which is free in the insertion direction, is formed by an edge 348' that is linear, has a stepped thickness, and is otherwise beveled, whereas in the variant according to FIG. 9B, beveled edge 349' is linear in the center with respect to its thickness and is stepped in both other thickness areas.

Figure 10:
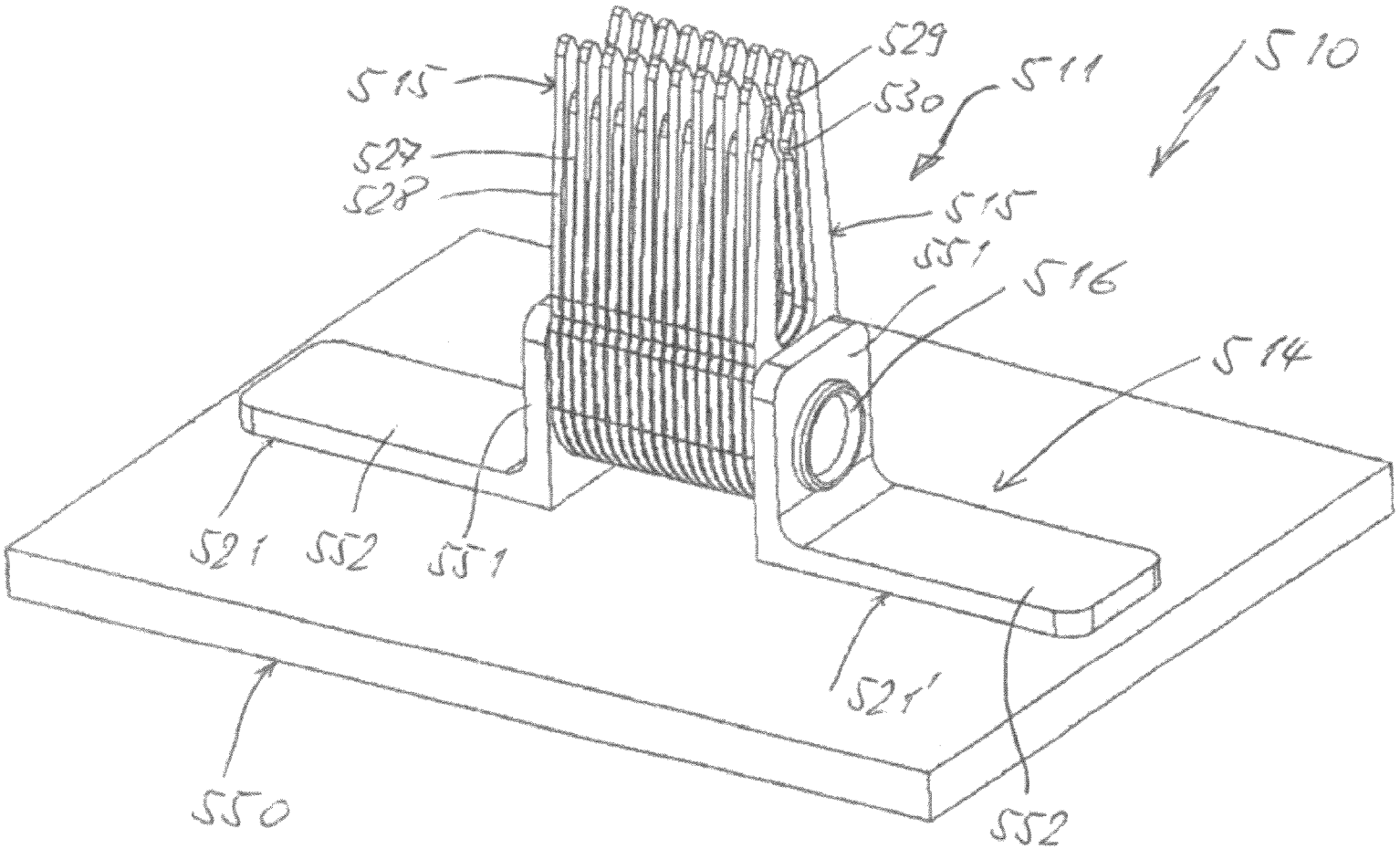
FIG. 10 is an isometric view of a spring contact unit in accordance with another embodiment of the present invention.

FIG. 10 shows a contact arrangement 510 in which only one fork contact 511 is shown, into which a blade contact unit (18 of FIG. 6A) may be inserted to create a connection. Fork contact unit 511 differs from unit 11 of FIG. 1 in that carrier 516, which here receives spring fork contacts 515 as one or more packets, is fixed to a circuit board 550 by a connecting unit 514. For this purpose, the two ends of carrier 516, which is here also tubular, are fixedly joined to a right-angled attachment bracket 521, 521' of connecting unit 514. Carrier 516 is fixed to short leg 551 of attachment bracket 521, 521'. Long leg 552 of attachment bracket 521, 521' is attached to circuit board 550 at the appropriate location in an electrically conductive manner.

In the embodiment depicted in FIG. 10, spring fork contacts 515 of spring contact unit 511, are provided with a short spring leg 527 and a long spring leg 528, so that here as well contact points 529, 530 are situated in planes so they engage the faces of a blade contact sequentially in the plug-in direction. It is obvious that this spring contact unit may instead be furnished with spring fork contacts 15 in one or two packets.

In this way, contact points 529, 530 of varying-length spring legs 529, 528 are situated on different planes, because adjoining spring fork contacts 515 are arranged so as to be rotated 180° about their central longitudinal axis in alternating fashion. In other words, short and long spring legs 527, 528 are arranged so as to adjoin each other.

In accordance with undepicted exemplary embodiments, the modification of the plug-in forces is determined both on spring contact unit 11, 11' as well as on blade contact unit 12, 112, 212, 312, 412. Furthermore, instead of double packets of spring fork contacts 15, 15', it is also possible to arrange more than two packets 36, 37 on one carrier. In addition, it is possible to provide two or more connecting units 14, 114, both on spring contact units 11 as well as on blade contact units 12, 112, 212, 312, 412, so that the current being supplied in both directions may be divided among multiple conductors to a specific unit 11, 12.

The integral design of connecting unit 19, 119, etc., with blade contact unit 12, 112, etc., may be achieved using the so-called MIM (metal injection molding) process.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A contact arrangement comprising:

a blade contact which has opposite faces;

a plurality of fork contacts (15) that each comprises a primarily plate-shaped piece of conductive material having a slot (17) that forms a pair of spring legs (27, 28) with free forward ends (27*e*, 28*e*) forming contact points (29, 30) and with rearward ends that merge into a base area (25);

said blade contact lying in said slots of said plurality of fork contacts with the spring leg forward ends lying against opposite faces of said blade contact;

said plurality of fork contacts lying in at least one stack with each fork contact lying facewise against an adjacent fork contact in the stack;

said fork contacts have cylindrical holes (26) in their base areas and including a carrier (16) with a cylindrical outside surface that has an axis (52) and that projects closely through said cylindrical holes in said fork contact base areas to confine said fork contacts to pivoting about said axis (52).

2. The contact arrangement described in claim 1, wherein:

said fork contacts that lie in at least one stack, lie facewise against one another but are free to pivot individually about said axis (52).

3. A contact arrangement comprising:

a blade contact which has opposite faces;

a plurality of fork contacts (15) that each comprises a primarily plate-shaped piece of conductive material having a slot (17) that forms a pair of spring legs (27, 28) with free forward ends (27*e*, 28*e*) forming contact points (29, 30) and with rearward ends that merge into a base area (25);

said blade contact lying in said slots of said plurality of fork contacts with the spring leg forward ends lying against opposite faces of said blade contact;

said plurality of fork contacts lying in at least one stack with each fork contact lying facewise adjacent to an adjacent fork contact in the stack;

said fork contacts are free to pivot about their base areas so each fork contact engages said blade contact;

said plurality of fork contacts lie in first and second stacks that have aligned stack axes; and including a connector (14) that lies between said first and second stacks and a shaft (16) that mounts on said connector and that passes through said through holes in said fork contacts.

4. A contact arrangement comprising:

a blade contact which has opposite face;

a plurality of fork contacts (15) that each comprises a primarily plate-shaped piece of conductive material having a slot (17) that forms a pair of spring legs (27, 28) with free forward ends (27*e*, 28*e*) forming contact points (29, 30) and with rearward ends that merge into a base area (25);

said blade contact lying in said slots of said plurality of fork contacts with the spring leg forward ends lying against opposite faces of said blade contact;

said plurality of fork contacts lying in at least one stack with each fork contact lying facewise adjacent to an adjacent fork contact in the stack;

said fork contacts are free to pivot about their base areas so each fork contact engages said blade contact;

said stack of fork contacts has a stack axes (52) extending in a longitudinal direction, with said fork contacts having aligned holes in their base areas;

a shaft-shaped carrier (16) that extends along said aligned holes;

a connector (14) which has a hole (24) through which said shaft-shaped carrier extends, said connector having a pin (21) extending perpendicular to said longitudinal direction.

5. A contact arrangement comprising:

a blade contact which has opposite faces;

a plurality of fork contacts (15) that each comprises a primarily plate-shaped piece of conductive material having a slot (17) that forms a pair spring legs (27, 28) with free forward ends (27*e*, 28*e*) forming contact points (29, 30) and with rearward ends that merge into a base area (25) that has a fork contact axis (52);

said blade contact lying in said slots of said plurality of fork contacts with the spring leg forward ends lying against opposite faces of said blade contact;

said pluratity of fork contacts lying in at least one stack with each fork contact lying facewise adjacent to an adjacent fork contact in the stack;

said fork contacts are free to pivot about their base areas so each fork contact engages said blade contact;

the pair of spring legs of each of a plurality of said fork contacts of said stack, have contact points (339, 340) differently spaced from the corresponding fork contact axis;

alternate fork contacts in said stack are turned 180° from an adjacent fork contact, so a first contact point (329) of said first stack engages a first face (18A) of said blade contact and fork contacts lying immediately beyond said first fork contact have their second contact points (330) engaging said second face (18B) of said blade contact, with said contact points (329, 330) being differently spaced from the corresponding fork contact axis.

6. A contact arrangement comprising:

a blade contact (18) which has opposite blade faces that face in opposite directions;

a plurality of fork-shaped contacts arranged in a stack, each fork-shaped contact having a forward portion that forms a vertical fork slot (17) that receives said blade contact with said fork slot dividing the fork-shaped contact forward portion into two primarily vertical legs (27, 28) that have contact points (29, 30) that engage said opposite faces of said blade contact;

said fork-shaped contacts each having a rear portion with a through hole (26) that is spaced a distance (W) from said fork slot and that has a hole axis (52);

a carrier (16) that has a cylinder shaft of the same diameter as said through hole and that projects through said through hole in said fork-shaped contacts, said fork-shaped contacts being pivotal on said carrier about said hole axis (52);

each fork-shaped contact formed of a metal plate with said fork-shaped contacts lying against one another in the stack but being free to individually pivot about said hole axis.

7. The contact arrangement described in claim 6 wherein:

said fork-shaped contacts are each constructed of a single plate of metal with said legs and said fork contact rear portion being integral;

said through holes of said fork-shaped contact lie on a hole axis (52), and the two contacts points of each of said fork-shaped contacts are differently spaced from said hole axis.

* * * * *